United States Patent [19]

Dean et al.

[11] Patent Number: 4,586,363

[45] Date of Patent: May 6, 1986

[54] BLIND RIVETING MACHINE

[75] Inventors: Sidney Dean, Sutton Coldfield; John G. Butcher, Great Barr, both of England

[73] Assignee: USM Corporation, Farmingtor Conn.

[21] Appl. No.: 740,540

[22] Filed: Jun. 3, 1985

[30] Foreign Application Priority Data

Jun. 5, 1984 [GB] United Kingdom ..... 8414343

[51] Int. Cl.[4] ..... B21D 31/00

[52] U.S. Cl. ..... 72/391; 72/424; 227/116

[58] Field of Search ..... 72/424, 428, 391; 227/114, 116

[56] References Cited

U.S. PATENT DOCUMENTS 3,815,805 6/1974 Oscar et al. ..... 227/116

3,987,950 10/1976 Schmidt et al. ..... 227/116

*Primary Examiner*—Leon Gilden

*Attorney, Agent, or Firm*—Alan N. McCartney

[57] ABSTRACT

A blind-riveting machine comprises a transfer device having suction means to hold a mandrel stem and carry it into vertical alignment with a bore in a nosepiece of a rivet-setting device. With the blind-riveting assembly thus poised, the suction is released and the mandrel stem drops into the nosepiece, which holds the assembly when the transfer device retracts.

6 Claims, 6 Drawing Figures

BLIND RIVETING MACHINE

BACKGROUND OF THE INVENTION

1. Field of the Invention

This invention is concerned with a blind-riveting machine comprising a transfer device for transferring a blind-riveting assembly from a receiving position to the nosepiece of a rivet-setting head of the machine.

2. Summary of the Prior Art

The expression "blind-riveting assembly" is used herein to denote an assembly of a type comprising a hollow rivet and a mandrel, the mandrel having a head and a stem, part of which lies within a tubular portion of the rivet and part of which projects from one end of the rivet. The mandrel head is too large to pass through the tubular portion of the rivet without deforming it, and the arrangement being such that after the tubular portion of the rivet has been inserted into a hole in a workpiece from one side, the rivet can be set by causing the mandrel head to effect radial expansion of the tubular portion at the other side of the workpiece upon pulling the mandrel stem and while holding the rivet against bodily movement relative to the workpiece. Usually, in blind-riveting the rivet has a head at the end from which the mandrel stem projects, and to set the rivet, use is made of a rivet-setting device comprising a nosepiece, which has a bore to receive the projecting part of the mandrel stem and provides an abutment to engage the rivet head and hold it against bodily movement relative to the workpiece during setting. The mandrel-pulling means pulls the projecting part of the mandrel stem along a longitudinal axis of the rivet-setting device coaxial with the bore in the nosepiece.

In U.S. Pat. No. 3,580,475 there is described a blind-riveting machine which has a rivet-setting device and a transfer device for transferring blind-riveting assemblies from a receiving position, to which they are fed one after another along a raceway from a bulk supply in a hopper, to the nosepiece of the rivet-setting device. The transfer device described comprises a slide bar with a spiral groove in it so that it rotates at the same time as it reciprocates for the purpose of reorientating a blind-riveting assembly during transfer, and is relatively complex and expensive to manufacture. Moreover, the rivet-setting device itself is mounted for reciprocation towards and away from a work support in order that it can accept a blind-riveting assembly during its advance towards the work support.

BRIEF SUMMARY OF THE INVENTION

It is an object of the present invention to provide a blind-riveting machine with improved means for transferring blind-riveting assemblies from a pick-up position to a nosepiece of a rivet-setting device of the machine.

The invention provides a blind-riveting machine comprising a transfer device for transferring a blind-riveting assembly from a receiving position to a nosepiece of a rivet-setting head of the machine, said device comprising a pick-up member reciprocable between a pick-up position and a delivery locality in alignment with said nosepiece, and the machine comprising means for presenting blind-riveting assemblies one at a time to said pick-up position in an upright position with the rivet uppermost, said pick-up member having a face with a vertical groove in it for reception of the mandrel stem and means for temporarily holding the mandrel stem in said groove, said member, in the operation of the machine, advancing to said delivery position at which the mandrel stem is aligned with an upwardly facing nosepiece, and the machine comprising means for releasing the mandrel stem from said member so that it falls into the nosepiece before said member retracts to its assembly-receiving position.

In a machine in accordance with the invention, the means for temporarily holding a mandrel stem in the groove of said pick-up member may be provided by a hole, for example an elongated slot halfway along the groove, in the side of the groove through which air is drawn by suction in the operation of the machine, and the means for releasing the mandrel stem arranged to cut off said suction.

Preferably, in a machine in accordance with the invention, the arrangement is such that an assembly for pick-up by said member is presented at such a height that it has far enough to drop at the delivery locality for the mandrel to be inserted in the nosepiece before the rivet head is obstructed by said member in its vertical descent. Air may also be drawn by suction through the nosepiece of the setting tool.

A machine in accordance with the invention may have a plurality of nosepieces arranged side by side and said pick-up member of the transfer device may have a corresponding number of grooves similarly arranged for simultaneous delivery of a corresponding number of blind-riveting assemblies.

A machine in accordance with the invention may have the rivet setting device fixed or movable relative to a work support.

There now follows a detailed description, to be read with reference to the accompanying drawings, of a transfer device of a blind-riveting machine in accordance with the invention and illustrative thereof. It will be realised that this illustrative blind-riveting machine has been selected for description by way of example and not of limitation of the invention.

DESCRIPTION OF THE PREFERRED EMBODIMENT

Figure 1:
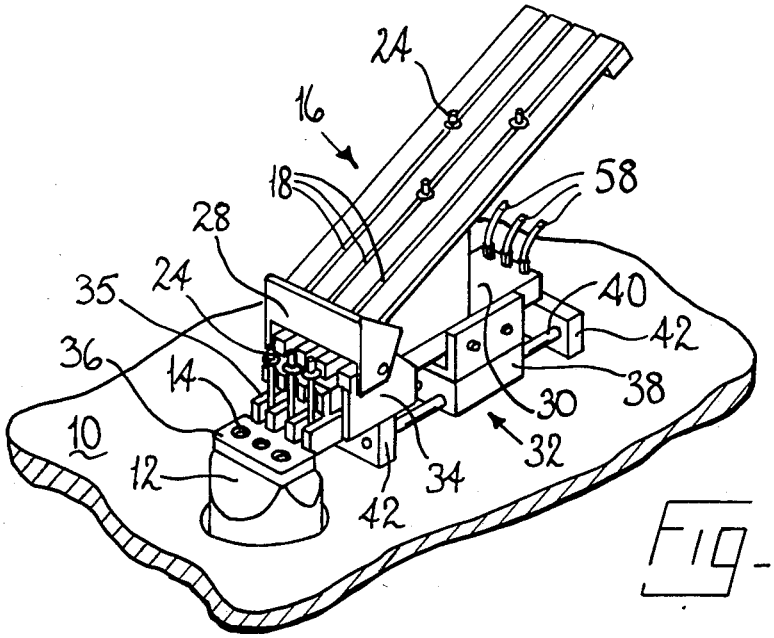
FIG. 1 is a view in perspective of a portion of the illustrative machine including a rivet-setting head and a transfer device for delivering three blind-riveting assemblies simultaneously to three upwardly facing nosepieces of the setting device.
Figure 2:
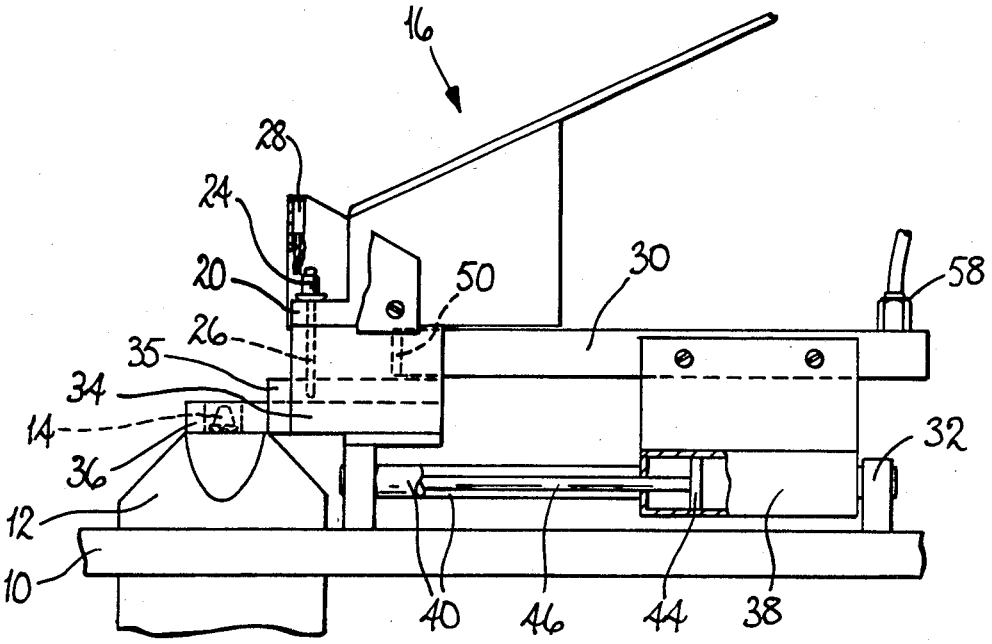
FIG. 2 is a view in side elevation and partly in section of the portion of the illustrative machine shown in FIG. 1
Figure 3:
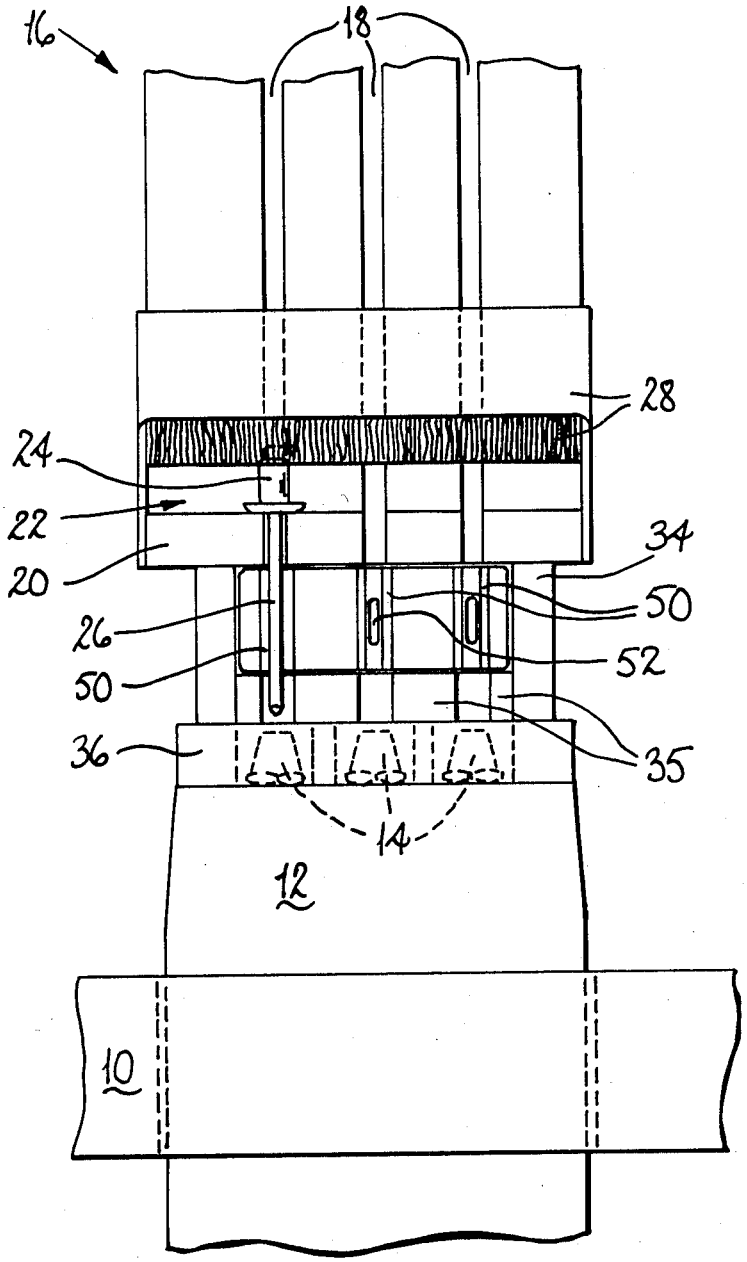
FIG. 3 is a view in front elevation and on a larger scale than FIG. 2 of the portion of the illustrative machine shown in FIG. 1.

The illustrative machine comprises a table 10 (FIGS. 1, 2 and 3) through which projects upwardly a rivet-setting head 12 secured by a bracket (not shown) to the table 10. The head 12 has three upwardly facing nosepieces 14 arranged in a row transversely of the table. Rearwardly of the setting head 12 is the delivery end of supply means indicated generally at 16 in FIG. 1. A vibratory hopper (not shown) delivers blind-riveting assemblies one by one to the upper ends of three inclined raceways 18 spaced side by side to correspond to the dispositions of the nosepieces 14. A separator mechanism (not shown) adjacent the lower ends of the raceways releases the assemblies one by one simultaneously from each raceway so that the three leading assemblies rest on a shelf 20 disposed behind the nosepieces. Means (not shown) is provided for adjusting the height of the shelf so that, if assemblies of the same size are being fed to all three nosepieces, the shelf is spaced above the nosepieces by a little more than the length of the mandrel stem projecting from the rivet head. A blind-riveting assembly 22 comprising a rivet 24 a mandrel 26 is shown resting on the shelf 20 in FIGS. 2 and 3. An elongated brush 28 with depending bristles is arranged above the shelf across the front of the raceways to retain the assemblies on the shelf until they are picked up by a pick-up arm 30 of a transfer device 32 now to be described.

The pick-up arm 30 is mounted to reciprocate forwardly and rearwardly behind the rivet-setting head 12 on a support 34. A rear portion of the pick-up arm 30 is supported by a pneumatic cylinder 38 slideable upon guide rods 40 mounted on brackets 42 upstanding from the table 10. In the cylinder 38 is disposed a piston 44 fixed to a rod 46 secured to a front one of the brackets 42 so that admission of air alternately (by means not shown) to the cylinder 38 at one side and the other of the piston causes the cylinder 38 and pick-up arm 30 to reciprocate. The support 34 is also mounted on the front bracket 42 and provides a forwardly projecting ledge 36 with three holes in it which shroud the nosepieces 14 and upstanding ribs 35 with open channels between them disposed in alignment with the raceways 18. The ledge 36 not only provides a work support, but together with the ribs 35 affords protection for the operator's fingers.

Figure 4:
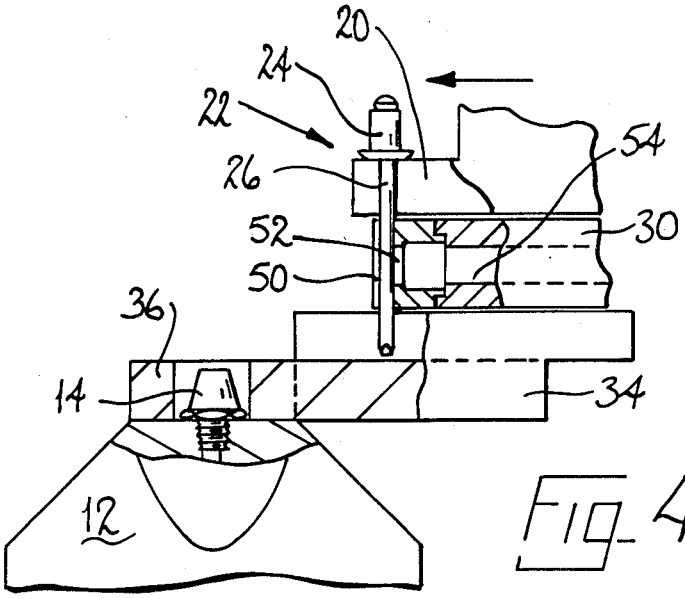
FIGS. 4, 5 and 6 are fragmentary views in side elevation of parts of the illustrative machine at successive stages in an operating cycle of the transfer device.

The pick-up arm 30 of the illustrative machine has three vertical grooves 50 (FIG. 3) in its front end face, spaced apart to correspond to the spacing of the raceways 18 and nosepieces 14. Each groove has a vertical slot 52 halfway along it, and each slot 52 leads to an individual passage 54 (FIG. 4) which extends rearwardly through the pick-up arm 30 and to one of three vacuum pumps (not shown) via separate flexible hoses 58. Valve means (not shown) enables air to be drawn selectively through one, two or three of the passages 54 depending on how many assemblies are being delivered simultaneously to the setting head 12.

Conveniently, in the operation of the illustrative machine, three blind riveting assemblies 22 are released simultaneously from the raceways 18 to fall onto the shelf 20, where they are prevented from falling off by the brush 28; the arm 30 at this time is in its rearward position behind the shelves. With air being drawn through the slots 52, air is admitted under pressure to the cylinder 38 in front of the stationary piston 44 to advance the arm 30, which picks up the three assemblies 22 simultaneously, the mandrels 26 being accommodated in the grooves 50 and, by closing the slots 52, being held there by suction. The assemblies 22 thus travel at the same height as they were picked up by the arm 30, their rivet heads spaced above the arm 30 by the distance between the top of the arm and the top of the shelf 20. Thus they arrive in alignment with the nosepieces 14 and just above them.

Figure 5:
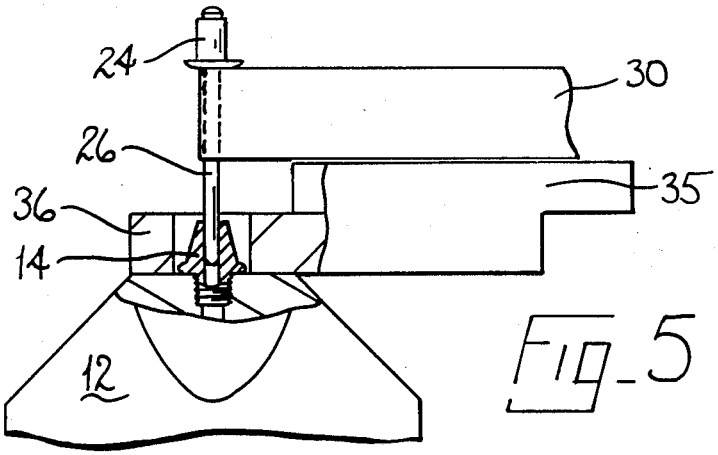
Figure 6:
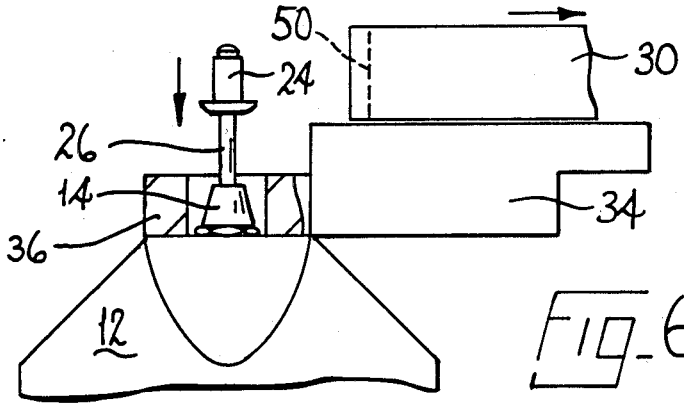

When, in the operation of the illustrative machine, the pick-up arm 30 reaches its foremost position, a valve (not shown) controlling air flow through the hose 58 switches off the vacuum and allows air pressure in the passages 54 to stabilise so that the assemblies 22 drop until the heads of their rivets 24 rest on the arm 30 and the mandrel stems are received in the nosepieces (see FIG. 5). The action of the cylinder 38 is now reversed, and the arm 30 retracts (FIG. 6). The mandrels now drop fully into the nosepieces 14, aided by suction through the nosepieces if the rivet setting device is so arranged.

Suction through the slots 52 is restored before the next advance of the arm 30.

Admission of the stems of the mandrels 26 to the nosepieces 14 before the arm 30 retracts ensures that they are reliably delivered, such transfer being assured by the suction means which effects their being carried with their rivet heads sufficiently far above the slide to allow them to fall vertically far enough without interference.

Whereas the illustrative machine has been described set up to deliver three assemblies in a row simultaneously to correspondingly disposed nosepieces, it will be realised that a similar arrangement can be provided to deliver one or more assemblies at a time to a chosen disposition of nosepieces. Whereas, too, the rivet setting device of the illustrative machine is fixed to the table 10, a machine in accordance with the invention may have a rivet-setting head which itself reciprocates or otherwise moves from a position at which it receives one or more assemblies to a rivet-setting locality.

We claim:

1. A blind-riveting machine comprising a transfer device for transferring a blind-riveting assembly from a receiving position to a nosepiece of a rivet-setting head of the machine, said device comprising a pick-up member reciprocable between a pick-up position and a delivery locality in alignment with said nosepiece, and the machine comprising means for presenting blind-riveting assemblies one at a time to said pick-up position in an upright position with the rivet uppermost, said pick-up member having a face with a vertical groove in it for reception of the mandrel stem and means for temporarily holding the mandrel stem in said groove, said member, in the operation of the machine, advancing to said delivery position at which the mandrel stem is aligned with an upwardly facing nosepiece, and the machine comprising means for releasing the mandrel stem from said member so that it falls into the nosepiece before said member retracts to its assembly receiving position.

2. A machine according to claim 1 in which the means for temporarily holding the mandrel stem is provided by a hole in the side of said groove through which air is drawn by suction in the operation of the machine.

3. A machine according to claim 2 in which said hole is provided by slot which runs longitudinally along a middle part of said groove.

4. A machine according to claim 1 comprising means at the pick-up locality for presenting an assembly for pick-up by said member at such a height that the assembly has far enough to drop at the delivery locality for the mandrel to be inserted in the nosepiece before the rivet head in its vertical descent is obstructed by said member.

5. A machine according to claim 1 comprising means for drawing air by suction through the nosepiece of the rivet-setting head.

6. A machine according to claim 1 comprising a plurality of nosepieces arranged side by side, the transfer device having a corresponding row of grooves for the reception of blind-riveting assemblies to be delivered simultaneously to the several nosepieces.

* * * * *